United States Patent [19]

Byrnes

[11] 4,280,525

[45] Jul. 28, 1981

[54] TAMPERPROOF CAP ASSEMBLY FOR HYDRANT

[75] Inventor: Francis R. Byrnes, Philadelphia, Pa.

[73] Assignee: Center Compression Lock Company, Inc., Philadelphia, Pa.

[21] Appl. No.: 31,272

[22] Filed: Apr. 18, 1979

[51] Int. Cl.[3] ..... E03B 9/06

[52] U.S. Cl. ..... 137/296; 220/203; 220/316; 137/800

[58] Field of Search ..... 137/272, 294, 296, 299, 137/637.1, 800, 288, 287, 383, 384.2; 138/92; 222/153; 285/DIG. 2; 220/210, 315, 375, 203, 316; 251/318, 319

[56] References Cited

U.S. PATENT DOCUMENTS

| | | | |
|---|---|---|---|
| 468,782 | 2/1892 | Brentano | 137/296 |
| 556,500 | 3/1896 | Fox | 137/296 |
| 969,905 | 9/1910 | Reed | 137/800 X |
| 3,914,966 | 10/1975 | Bello | 137/296 X |
| 4,062,375 | 12/1977 | Byrner | 251/291 |
| 4,164,221 | 8/1979 | Bentley et al. | 251/319 |

*Primary Examiner*—Martin P. Schwadron

*Assistant Examiner*—G. L. Walton

*Attorney, Agent, or Firm*—Seidel, Gonda, Goldhammer & Panitch

[57] ABSTRACT

A tamperproof cap assembly for a hydrant having a valve stem rod which in one embodiment is displaceable in elevation within the hydrant housing without rotation of the valve stem rod about its axis. The assembly includes a cap adapted to cover the outlet port in the hydrant housing. The cap is provided with a stem. A locking means secured to the valve stem rod engages the cap stem when the valve stem rod is in a first position and the cap stem is displaced toward the valve stem rod. The locking means releases the cap stem when the valve stem rod is displaced in elevation from the first position to a second position without rotation of the valve stem rod about its axis. The cap is provided with a pair of unthreaded facing annular walls which define an annular channel for receiving the hydrant nozzle. In another embodiment, the valve stem rod is rotatable, and a locking means secured to the rod engages the cap stem when the rod is in a first angular position and releases the stem when the rod is rotated away from the first angular position.

11 Claims, 5 Drawing Figures

FIG. 1
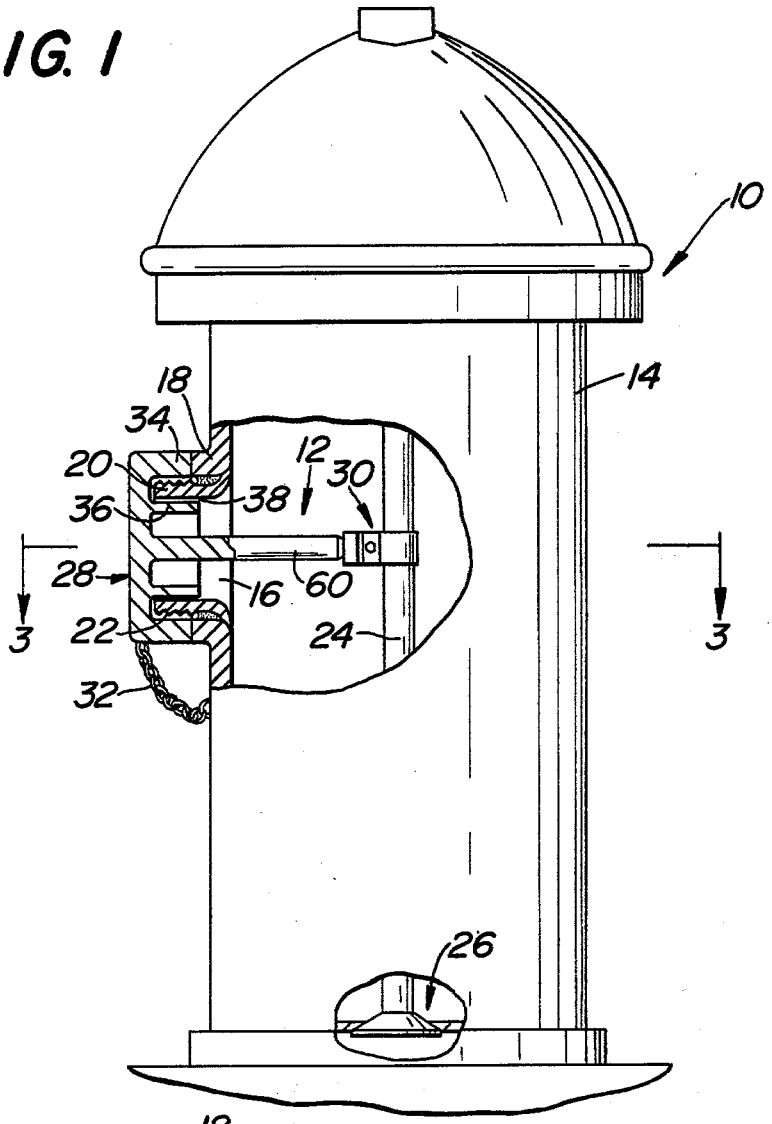
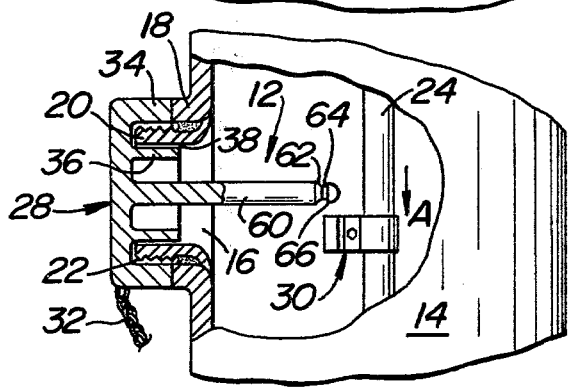
FIG. 2

FIG. 3
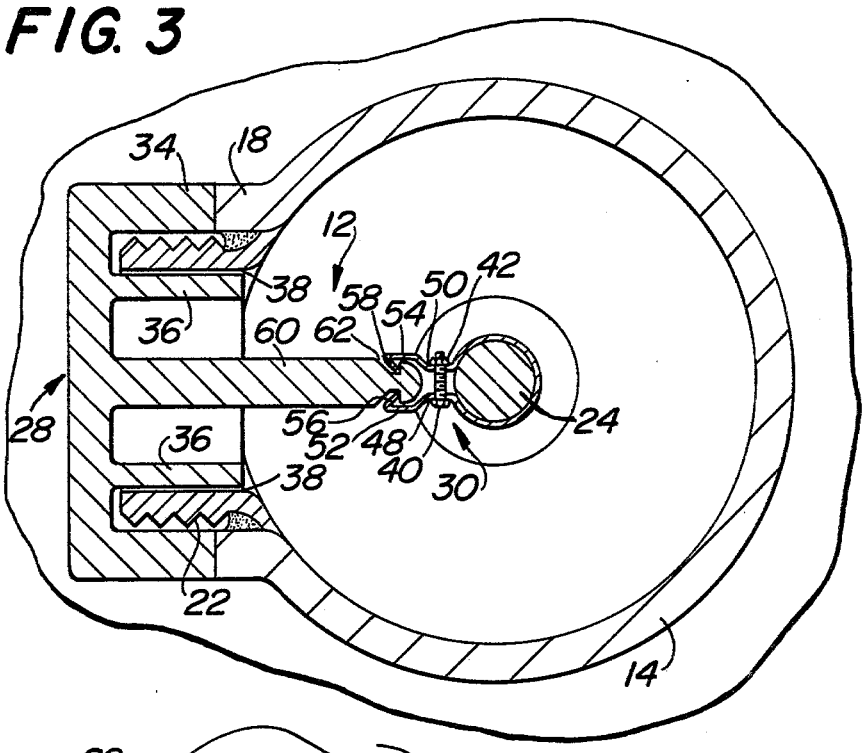
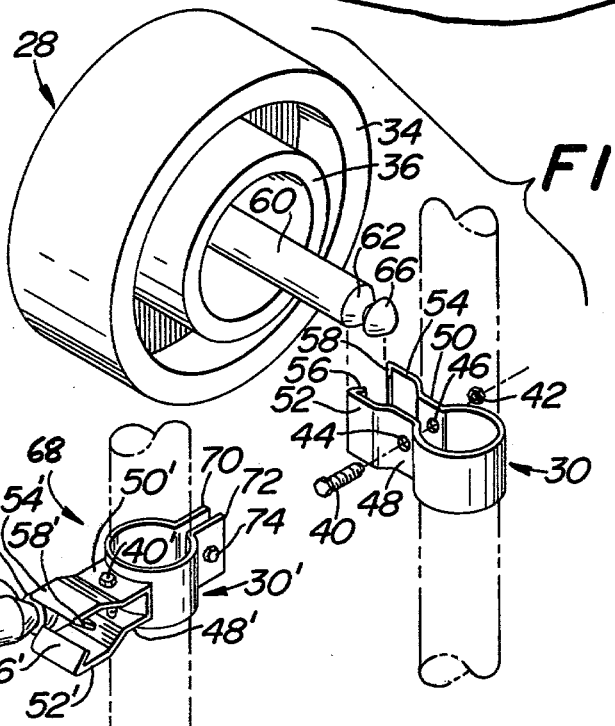
FIG. 4
FIG. 5

TAMPERPROOF CAP ASSEMBLY FOR HYDRANT

BACKGROUND OF THE INVENTION

The present invention is directed to a tamperproof cap assembly. In particular, the invention is directed to a cap assembly which may be used in combination with a hydrant having a valve stem rod which is operated to open and close the hydrant valve either by displacement of the valve stem rod in elevation without rotation of the valve stem rod about its axis or by rotation of the valve stem rod.

A hydrant having an operating mechanism for displacing the valve stem without rotating the stem is described in detail in U.S. Pat. No. 4,062,375 for "Tamperproof Lock" assigned to the assignee herein. The tamperproof cap assembly of the present invention is especially intended for use with such a hyrant.

Various tamperproof cap assemblies have been proposed heretofore. Such assemblies are, in general, unduly complex in structure and are not readily adapted for use with subsisting hydrants.

For example, in U.S. Pat. No. 468,782 for "Fire Hydrant," there is disclosed a cap which is hinged to the hydrant nozzle. The hydrant is provided with a casing having a projection which abuts the lug portion of the cap when the cap is closed on the hydrant nozzle. A curved bolt locks the lug portion to the projection. The valve stem rod is provided with an eccentric which is splined to the valve stem rod. Rotation of the valve stem rod causes the eccentric to displace a linkage thereby releasing the bolt to free the cap. Vertical displacement of the valve stem rod does not affect the operation of the eccentric. Accordingly, the rather complicated mechanism described in this patent is unsuitable for use with a hydrant having a valve stem rod which is displaceable in elevation but which is not rotatable about its axis.

Various other cap assemblies are described in U.S. Pat. Nos. 3,914,996 for "Protection Device And Tool For Fire Hydrant" and 556,500 for "Hydrant."

BRIEF SUMMARY OF THE INVENTION

A tamperproof cap assembly for a hydrant having a housing provided with an outlet port and a valve stem rod. In one embodiment, the rod is displaceable in elevation within the hydrant housing without rotation of the valve stem rod about its axis. The cap assembly includes a cap adapted to cover the hydrant outlet port. The cap is provided with a stem. A locking means is secured to the valve stem rod to engage the cap stem when the valve stem rod is in a first position and to release the cap stem when the valve stem is displaced in elevation from the first position to a second position without rotation of the valve stem about its axis. In another embodiment, the valve stem rod is rotatable, and a locking means secured to the rod engages the cap stem when the rod is in a first angular position and releases the stem when the rod is rotated away from the first angular position. The cap is provided with a pair of unthreaded facing annular walls which define an annular channel for receiving the hydrant nozzle surrounding the outlet port. The facing annular walls protect the outer threaded surface of the nozzle.

An advantage of the invention is that it requires no modification of the parts of a subsisting hydrant. The subsisting hydrant can be easily and rapidly retrofitted with the invention.

Another advantage of the invention is that it is of relatively simple construction and uses a minimum number of interacting components.

A further advantage of the invention is that it is truly reliable and tamperproof.

Further advantages appear hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. is a view of a fire hydrant partially cut away to show the tamperproof cap assembly in locked position in sectional elevation for a valve stem rod displaceable in elevation without rotation.

FIG. 2 is a partial sectional elevation of the hyrant showing the tamperproof cap assembly in the released position.

FIG. 3 is a sectional view of the tamperproof cap assembly taken along the lines 3—3 in FIG. 1.

FIG. 4 is an exploded isometric of the cap assembly and and valve stem clamp shown in FIGS. 1–4.

FIG. 5 is an isometric of the cap assembly and valve stem clamp for a valve stem rod which is rotatable.

DETAILED DESCRIPTION OF THE INVENTION

Referring to FIG. 1, there is shown a conventional hydrant 10 with the tamperproof cap assembly 12 of the present invention mounted thereon in locked position.

The hydrant 10 is provided with a barrel or housing 14. An outlet port 16 is formed in the housing 14 by an annular lip 18. An annular nozzle 20 welded to the lip 18 is provided with a threaded outer surface 22. The nozzle 20 communicates with the port 16.

A valve stem rod 24 is disposed within the housing 14. The valve stem rod 24 is a conventional element which reciprocates in a substantially vertical path to open and close the hydrant valve 26. A suitable operating mechanism for reciprocating the valve stem rod 24 is disclosed in U.S. Pat. No. 4,062,375 for "Tamperproof Lock" assigned to the assignee herein, wherein the valve stem rod 24 is identified as a plunger element.

The tamperproof cap assembly 12 includes a cap 28 and a resilient locking means or clamp 30. The cap 28 may be secured to the hydrant housing 14 by means of a chain 32. The chain has enough slack to permit the cap 28 to be removed from the nozzle 20 as described hereinafter. A cable or other attachment device may be used for the same purpose.

The cap 28 is provided with an annular peripheral wall 34 and an inner annular wall 36. Annular walls 34 and 36 define an annular channel 38 which receives the hydrant nozzle 20. See FIGS. 2 and 3. The annular peripheral wall 34 abuts against the hydrant annular lip 18 when the cap is installed over the nozzle 20. The annular walls 34 and 36 protect the threaded outer surface 22 of the nozzle 20, preventing access to the threaded outer surface by vandals or other unauthorized personnel.

The clamp 30 is rigidly secured to the valve stem rod 24 by a bolt 40 and nut 42. See FIGS. 3 and 4. The bolt 40 extends through a pair of holes 44, 46 drilled or tapped in the intermediate portions 48, 50 of the clamp.

See FIG. 4. The intermediate portions 48, 50 of the clamp 30 are connected to a pair of facing resilient jaws 52, 54. The jaws 52, 54 include a pair of facing flanges 56, 58. It is preferred that the flanges 56, 58 be inclined inward of the opening between jaws 52, 54.

The cap 28 is provided with a cap stem 60 having a conically tapered section 62, a reduced section 64, and a hemispherical member 66. See FIGS. 2 and 4. To install the cap 28 on the hydrant nozzle 20, the cap 28 is fitted over the nozzle 20 so that the annular channel 38 receives the nozzle 20. As the annular channel 38 receives the nozzle 20, the cap stem 60 is displaced toward the valve stem rod 24. The hemispherical member 66 of the cap stem 60 slideably contacts the facing flanges 56, 58, causing the resilient jaws 52, 54 to spread. As the wall 34 is brought into abutment with the lip 18, the hemispherical member 66 slides past the facing flanges 56, 58, and the jaws 52, 54 close. When the jaws 52, 54 close, the facing flanges 56, 58 are positioned behind the hemisphercal member 56 along the reduced section 64 of the cap stem 60. See FIG. 3. The bolt 40 and nut 42 are pre-tightened on the clamp 30 to ensure that the jaws 52, 54 lock the cap stem 60 in position so that the cap stem cannot be withdrawn from the clamp jaws by merely prying the annular peripheral wall 34 of the cap 28 away from the hydrant annular lip 18.

To release the cap stem 60 from the clamp 30, the valve stem rod 24 must be displaced in elevation from the locked position shown in FIG. 1 along the direction indicated by arrow A to the released position shown in FIG. 2. As the valve stem rod 24 is displaced in elevation, the jaws 52, 54 of clamp 30 descend from the cap stem 60 thereby releasing the cap stem 60 without spreading the jaws 52, 54. As the valve stem rod 24 and clamp 30 separate, the hydrant valve 26 opens permitting water to enter the hydrant housing 14. The water entering the housing 14 flows through the outlet port 16 and exerts an outward force against the cap 28, eventually pushing the cap 28 from the nozzle 20. It should be noted that the annular channel 38 of the cap 28 is not threaded so that the cap can be displaced from the nozzle 20 by water flowing through the outlet port 16.

In operation, the clamp 30 is secured to the valve stem rod 24. The clamp 30 is mounted on the rod 24 in alignment with the central portion of the outlet port 16. The cap 28 is installed on the hydrant nozzle 20 so that the annular peripheral wall 34 of the cap abuts against the hydrant flange 18. The nozzle 20 is received in the annular channel 38 of the cap. The threaded outer surface 22 of the nozzle 20 is protected by the annular walls 34 and 36 from tampering by unauthorized personnel. The hemispherical member 66 of the cap stem 60 slidingly contacts the flanges 56, 58 of clamp 30 thereby spreading the clamp jaws 52, 54. When the peripheral wall 34 and the hydrant lip 18 are in abutment, the hemispherical member 66 is locked by flanges 56, 58 between the clamp jaws 52, 54.

To use the hydrant 10, an operating mechanism such as the mechanism described in U.S. Pat. No. 4,062,375 is actuated to displace the valve stem rod in elevation. The operating mechanism causes the valve stem rod 24 to descend from the locked position shown in FIG. 1 to the released position shown in FIG. 2. As the valve stem rod descends, the hydrant valve 26 opens, admitting water to the interior of the housing 14. In addition, as the valve stem rod 24 descends, the clamp 30 is lowered and the clamp jaws 52, 54 release the cap stem 60. Water admitted through valve 26 to the interior of the hydrant housing 14 pushes the cap 28 away from the nozzle 20. At the same time, the water flushes any foreign material, rust and prior deposits of water out of the hydrant housing 14.

When the cap 28 is displaced from the nozzle 20, the cap remains secured to the housing 14 by chain 32. The operating mechanism is then actuated to raise the valve stem rod 24 from the released position shown in FIG. 2 to the locked position shown in FIG. 1. Accordingly, the hydrant valve 26 closes, preventing the entry of water into the hydrant housing 14. When the hydrant valve 26 is closed, a hose (not shown) is threadedly secured by the operator to the nozzle 20. Thereafter, the operating mechanism is actuated to again lower the valve stem rod 24, causing the hydrant valve 26 to open. When the hydrant valve 26 is open, water enters the hydrant housing 14 and flows through the outlet port 16 and nozzle 20 to the hose.

When use of the hydrant is completed, the operating mechanism is actuated to again raise the valve stem rod, thereby closing the hydrant valve 26. The operator unthreads the hose from the nozzle 20 and re-installs the cap 28 over the nozzle. The cap stem 60 is thereby and locked in position by clamp 30 as previously described.

In FIG. 5, there is shown an alternative embodiment of the invention for use with a conventional valve stem rod which is rotatable. A ring 68 is secured to the valve stem rod 24 by a bolt 74 and nut (not shown) which couple ring elements 70 and 72. A clamp 30′ is welded or otherwise secured to ring 68. When the hydrant valve is closed, the clamp 30′ is aligned to receive the cap stem 60′. The clamp 30′ comprises facing resilient jaws 52′, 54′ having facing flanges 56′, 58′. A bolt 40′ extends through intermediate portions 48′, 50′ of clamp 30′. The bolt 40′ and a nut (not shown) are pre-tightened on clamp 30′ to ensure that the jaws 52′, 54′ lock the cap stem 60′ on position when the cap 28 is installed on the hydrant nozzle as already described. Accordingly, the stem cannot be withdrawn from the clamp jaws by prying wall 34 of cap 28 away from the hydrant lip 18.

To release cap stem 60′ from clamp 30′, the valve stem rod is rotated away from the position wherein the stem is locked in jaws 52′, 54′. As the rod rotates, jaws 52′, 54′ rotate and release stem 60′ without spreading jaws 52′, 54′. As the valve stem rod is rotated, the cap stem and clamp separate and the hydrant valve 26 opens. Water then enters housing 14, eventually pushing cap 28 away from nozzle 20 as already described. The valve stem rod is then rotated back towards the original position wherein clamp 30′ is aligned to receive cap stem 60′, and the hydrant valve closes. A hose can then be secured to nozzle 20, and the valve stem rod can be rotated to again open the hydrant valve to permit water to flow through the hydrant and hose, all as previously described.

When use of the hydrant is completed, the valve stem rod is rotated to again close the hydrant valve, and clamp 30′ is brought into alignment to again receive cap stem 60′. Cap 28 is then re-installed on nozzle 20 and the cap stem 60′ is locked within jaws 52′, 54′ of clamp 30′ as already described.

An advantage of the invention is that it prevents unauthorized access to the hydrant nozzle. The cap 28 protects the threaded outer surface 22 of the hydrant nozzle from damage by vandals or other unauthorized personnel. The cap 28 cannot be grasped and pried away from the nozzle 20 due to the locking engagement of the cap stem 60 and clamp 30.

The invention may be used to retrofit any compression-type hydrant, that is, any hydrant which employs a member such as valve stem rod 24 for opening and closing the hydrant valve. Since the annular channel 38 of the cap is not threaded, there is no danger that the surfaces of the cap will become "frozen" on the threaded outer surface 22 of the nozzle 20. Since the cap 28 can only be separated from the nozzle 20 by force of the water entering housing 14 and pressing against the cap 28, the cap cannot be displaced from the nozzle 20 unless the hydrant operating mechanism is first actuated to displace the valve stem rod 24 to open the hydrant valve 26. In most cases, however, the operating mechanism itself will be tamperproof so that the valve stem rod 24 cannot be displaced by unauthorized personnel. Such an operating mechanism is described in U.S. Pat. No. 4,062,375.

Preferably, the cap 28 is a unitary structure so that the possibility of weakened connecting joints is eliminated. In addition, the outer surface of the cap 28 is smooth and free of any projecting surfaces which might be grasped by unauthorized personnel to withdraw the cap 28 from the hydrant nozzle.

The present invention may be embodied in other specific forms without departing from the spirit or essential attributes thereof and, accordingly, reference should be made to the appended claims, rather than to the foregoing specification, as indicating the scope of the invention.

I claim:

1. A tamperproof cap assembly for a hydrant having a housing provided with an outlet port and a nozzle surrounding said port and a valve stem rod displaceable in elevation within the hydrant housing without rotation of the valve stem rod about its axis, comprising:

a cap adapted to be displaceably mounted on said nozzle;

said cap having a stem;

locking means secured to said valve stem rod for engaging said cap stem to prevent displacement of said cap when said valve stem rod is in a first position and said cap is mounted on said nozzle and for releasing said cap stem to permit displacement of said cap when said valve stem rod is displaced in elevation from said first position without rotation of the valve stem rod about its axis.

2. The tamperproof cap assembly according to claim 1 wherein said locking means includes a clamp having a pair of resilient jaws, and wherein said cap stem is provided with a member for slideably contacting and spreading said clamp jaws and then causing said clamp jaws to close when said cap is displaceably mounted on said hydrant nozzle.

3. The tamperproof cap assembly according to claim 2 wherein said clamp jaws release said cap stem member when said valve stem rod is displaced in elevation.

4. The tamperproof cap assembly according to claim 2 or 3 wherein said cap stem includes a conically tapered section, a reduced section connected thereto, and said cap stem member is a hemispherical-shaped member.

5. The tamperproof cap assembly according to claim 1 wherein said cap is provided with an unthreaded annular channel for receiving said hydrant nozzle.

6. A tamperproof cap assembly for a hydrant having a housing provided with an outlet port and a nozzle surrounding said outlet port and a valve stem rod displaceable in elevation within the hydrant housing without rotation of the valve stem rod about its axis, comprising:

a cap adapted to be displaceably mounted on said hydrant nozzle;

said cap having a member operatively associated with said valve stem rod;

locking means secured to said valve stem rod for engaging said cap member to lock said cap in position on said hydrant nozzle when said cap is mounted on said hydrant nozzle and for releasing said cap member to permit displacement of said cap when said valve stem rod is displaced in elevation without rotation of the valve stem rod about its axis.

7. The tamperproof cap assembly according to claim 6 wherein said cap is provided with an unthreaded annular channel for receiving said hydrant nozzle.

8. A tamperproof cap assembly for a hydrant having a housing provided with an outlet port and a nozzle surrounding said outlet port and a valve stem rod displaceable in elevation within the hydrant housing without rotation of the valve stem rod about its axis, comprising:

a cap adapted to be displaceably mounted on said hydrant nozzle;

said cap having a member operatively associated with said valve stem rod;

said cap having an unthreaded annular channel for receiving said hydrant nozzle;

locking means secured to said valve stem rod for engaging said cap member to lock said cap in position on said hydrant nozzle when said cap is displaceably mounted on said hydrant nozzle and for releasing said cap member to permit displacement of said cap when said valve stem rod is displaced in elevation without rotation of the valve stem rod about its axis.

9. A tamperproof cap assembly for a hydrant having a housing provided with an outlet port and a nozzle surrounding said port and a valve stem rod rotatable within the hydrant housing, comprising:

a cap adapted to be displaceably mounted on said nozzle, said cap having a stem, locking means secured to said valve stem rod for engaging said cap stem to prevent displacement of said cap when said valve stem rod is in a first position and said cap is mounted on said nozzle and for releasing said cap stem to permit displacement of said cap when said valve stem rod is rotated away from said first position.

10. The tamperproof cap assembly according to claim 9 wherein said locking means is a clamp having a pair of resilient jaws, and said cap stem is provided with a member for slideably contacting and spreading said clamp jaws and then releasing said clamp jaws.

11. A tamperproof cap assembly for a hydrant having a housing provided with an outlet port and a nozzle surrounding said outlet port and a valve stem rod displaceable from a first position within the hydrant housing, comprising:

a cap adapted to be displaceably mounted on said hydrant nozzle;

said cap having a member which extends substantially laterally within said hydrant housing towards said valve stem rod;

resilient locking means secured to said valve stem rod for slideably engaging said cap member within said hydrant housing to lock said cap in position on said hydrant when said valve stem rod is in said first position and said cap is displaceably mounted on said hydrant nozzle and for slideably releasing said cap member to permit displacement of said cap when said valve stem rod is displaced from said first position.

* * * * *